US005690047A

United States Patent [19]

Holmes

[11] Patent Number: 5,690,047

[45] Date of Patent: Nov. 25, 1997

[54] BUOYANT ANCHORAGE MECHANISM

[76] Inventor: William C. Holmes, Rte. 123, South Harpswell, Me. 04079

[21] Appl. No.: 710,875

[22] Filed: Sep. 23, 1996

[51] Int. Cl.[6] ..... B63B 21/24

[52] U.S. Cl. ..... 114/294; 441/3; 114/297

[58] Field of Search ..... 114/293, 294, 114/296, 297, 298, 230, 54; 441/3, 11; D12/215

[56] References Cited

U.S. PATENT DOCUMENTS 3,608,510 9/1971 Vries ..... 114/54
3,950,806 4/1976 Puchois ..... 441/3

FOREIGN PATENT DOCUMENTS 258248 5/1963 Australia ..... 114/294

OTHER PUBLICATIONS

P. 58, Yachting Magazine, Feb. 1952.

*Primary Examiner*—Edwin L.. Swinehart
*Attorney, Agent, or Firm*—Frederick R. Cantor, Esq.

[57] ABSTRACT

A sea anchor may be lifted from the sea bottom by remotely inflating an inflatable float connected to the anchor. The inflated float provides a buoyant lift force that automatically lifts the anchor to the water surface or assists a person in lifting the anchor to the surface. The anchor may be lowered to the sea bottom by venting air out of the float from a remote point on the water surface.

6 Claims, 2 Drawing Sheets

BUOYANT ANCHORAGE MECHANISM

BACKGROUND OF THE PRESENT INVENTION

1. Field of the Invention

The present invention relates to a buoyant anchorage mechanism.

The present invention further relates to a sea anchor, and more particularly, an inflatable float device carried by the anchor for imparting an artificial buoyancy to the anchor, when it is desired to raise the anchor.

2. Prior Developments

Sea anchors are used to prevent ships, boats and buoys, from drifting away from desired anchorage points on the water surface. In some cases, it can prove difficult to raise the anchor from the sea bottom, e.g. if the anchor is relatively heavy, or, if the anchor has become embedded in the sea floor. The problem occurs particularly in situations where the anchor is in place for relatively long, uninterrupted time periods. Tides, underwater currents, and wind action on the water, can cause the sea floor to shift so as to embed the anchor in the sea floor material. It then becomes difficult to free the anchor from the sea floor surface in preparation for lifting the anchor to the vessel on the sea surface.

The present invention relates to a flotation device for lifting the anchor from the sea floor, or at least assisting the person aboard the surface vessel to more easily lift the anchor out of an embedded position on the sea floor. The flotation device can also be used for lifting a relatively heavy anchor that might otherwise pose a lifting problem.

SUMMARY OF THE PRESENT INVENTION

An object of the present invention is to provide a buoyant anchorage mechanism.

A further object of the present invention is to provide an inflatable-deflatable float carried by a sea anchor for imparting an artificial buoyancy to the anchor when it is desired to lift the anchor from the sea bottom to the water surface. The float is in a deflated (inactive) condition when the anchor is in its normal operating mode on the sea bottom. The terms "sea surface", "sea bottom", etc. are herein used in a generic sense to reference any body of water where anchors are used; e.g. lakes, rivers, oceans, harbors, etc.

The float is connected to an air pressure-generating means on the surface vessel, via a flexible conduit means that is generally coextensive with the line or cable used to raise or lower the anchor. The sea vessel can be any surface platform, such as a mooring buoy, sailboat, fishing boat, naval ship, etc. A typical anchor-raising operation would involve actuation of the air pressure-generating means on the surface vessel, whereby pressurized air is delivered downwardly through the flexible conduit means to the float on the anchor. The float is thus remotely inflated from the remote sea surface location, so as to impart buoyancy to the associated anchor.

The buoyant float exerts a lifting action on the anchor that is additive to any lifting force exerted by the lifter line or cable. In many cases, the lifting force is sufficient to raise the anchor to the water surface without any manual lifting force. In other cases, the buoyant float lift force, when combined with a manual lifting force on the line or cable, is sufficient to free the anchor from an embedded condition in the sea floor. The added lifting force may also be helpful in getting an unusually heavy anchor from the sea floor up to the water surface.

When the anchor is to be lowered from the surface vessel to the sea floor, the float is maintained in a deflated condition so as not to interfere with the normal anchor-lowering operation. Similarly, when the anchor is in its operating position on the sea floor, the float is in a deflated non-buoyant condition. The float does not interfere with the normal action of the anchor. The anchor can be any suitable anchor for the intended purpose; e.g. a mushroom anchor, an admiralty anchor, stockless anchor, Danforth anchor, or a Northill anchor.

The present invention can be used in conjunction with the anchoring of various surface vessels, e.g. buoys, sailboats, cabin cruisers, naval ships, cargo ships, etc. The invention is especially useful with mooring buoys that have to remain anchored in one spot for long periods of time, such that the anchor tends to become stuck in the soft bottom surface of the sea, lake, ocean or river. Such anchors should be periodically inspected. The present invention facilitates such inspection activities by making the anchoring-lifting operation relatively easy.

Further features of the present invention will be apparent from the attached drawings and description of an illustrative embodiment of the present invention.

In summary, and in accordance with the above discussion, the foregoing objectives are achieved in the following embodiments:

1. A raisable-lowerable anchorage mechanism comprising:

an anchor adapted to assume an operating position on the sea bottom or an inactive raised position at the sea surface;

an inflatable-deflatable float means carried by said anchor;

a surface vessel operable to support the anchor in its raised position;

air pressure-generating means on said vessel; and air conduit means connecting said air pressure-generating means to said float means, whereby said float means can be inflated or deflated from the sea surface.

2. The anchorage mechanism, as described in paragraph 1, wherein said float means has an internal displacement sufficient to lift said anchor from a submerged condition.

3. The anchorage mechanism, as described in paragraph 1, wherein said anchor comprises an elongated rod, and said float means comprises an annular float encircling said rod.

4. The anchorage mechanism as described in paragraph 1, and further comprising flexible means for raising or lowering said anchor; and said air conduit means being coextensive with said flexible raising-lowering means.

5. The anchorage mechanism as described in paragraph 4, wherein said flexible raising-lowering means comprises a flexible air hose that functions as the aforementioned air conduit means.

6. The anchorage mechanism as described in paragraph 1, wherein said float means comprises a fabric bag.

7. The anchorage mechanism as described in paragraph 1, and further comprising a stress-relief connection between said air conduit means and said float means, whereby said float means can be deflated without stressing the air conduit means.

8. The anchorage mechanism as described in paragraph 1, wherein said vessel comprises a mooring buoy.

9. A raisable-lowerable sea anchor for a surface vessel comprising:

an anchor having a density greater than water, whereby said anchor tends to sink to the sea bottom;

an inflatable-deflatable float means connected to said anchor for effectively varying the buoyancy of the float-anchor assembly; and means extending from said float means to the surface vessel for remotely inflating or deflating said float means.

A BRIEF DESCRIPTION OF THE DRAWINGS

DESCRIPTION OF THE PREFERRED EMBODIMENTS OF THE PRESENT INVENTION

Figure 1:
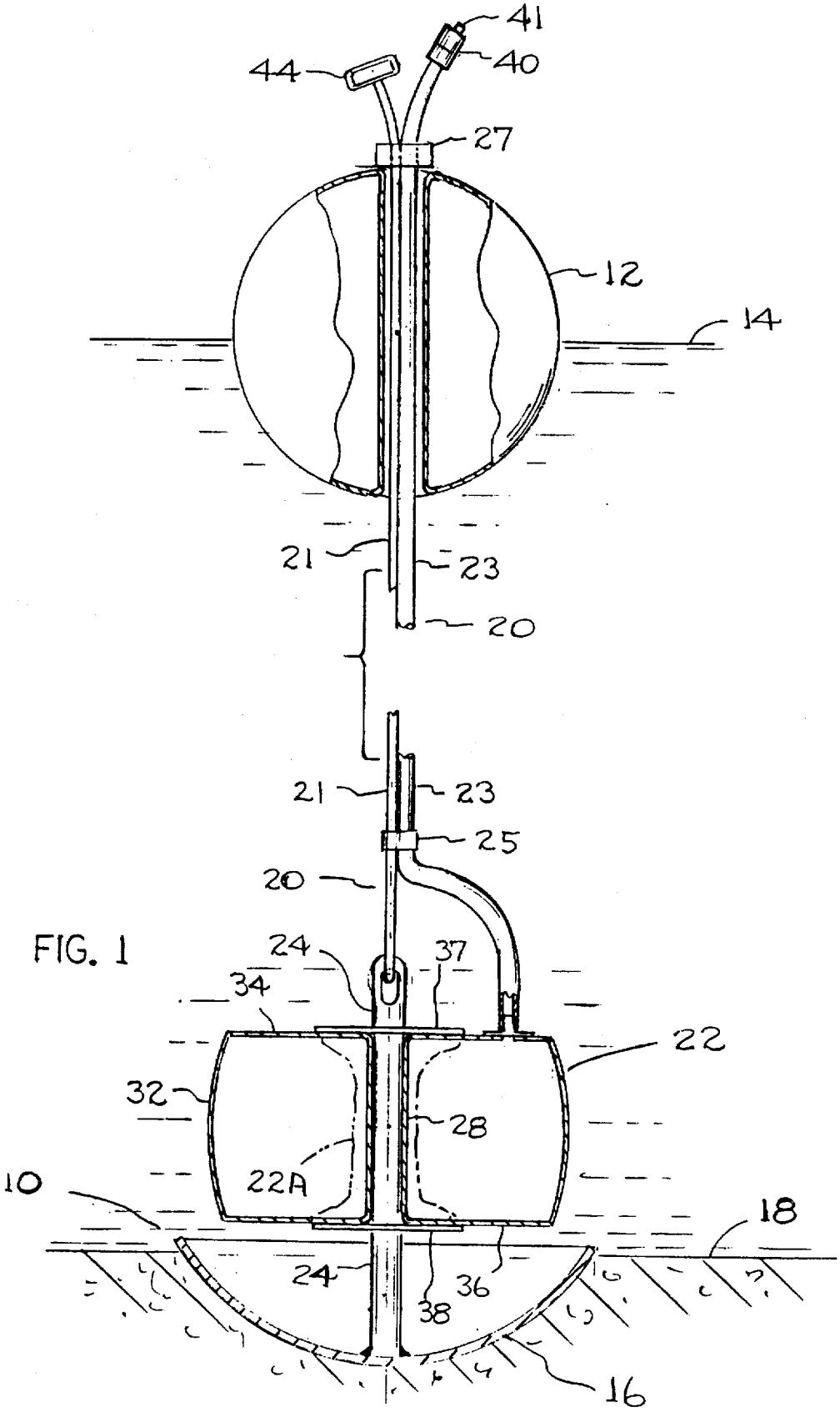
FIG. 1, is an elevational view of a float mechanism connected to an anchor used to hold a mooring buoy in a relatively fixed location, according to the invention.

FIG. 1, is an elevational view of a float mechanism connected to an anchor used to hold a mooring buoy in a relatively fixed location, according to the invention.

The drawing in FIG. 1 shows an anchorage mechanism 10, for retaining a surface vessel 12 in a relatively stationary position on the water surface 14. Vessel 12 can be a boat, ship or mooring buoy, of varying size and displacement. FIG. 1, shows the surface vessel as a mooring buoy.

The anchorage mechanism comprises a conventional anchor 16 adapted to rest on the sea bottom 18. The anchor 16 is connected to surface vessel 12, via a flexible connector means 20. In this particular system, the connector means 20 comprises a line 21 and an air hose 23, joined together by a lower clamp 25 and an upper clamp 27. The flexible hose 23 serves as an air conduit, whereby pressurized air can be delivered to and from an inflatable-deflatable float 22 carried by anchor 16.

Flexible connector means 20 serves the dual function of raising or lowering the anchor 16, and supplying pressurized air to the float 22 (or venting air from the float). If desired, the line 21 and conduit 23 could be combined together as a single hollow flexible element. Also, in the arrangement depicted in FIG. 1, line 21 can, if desired, take the form of a chain.

Anchor 16 is shown as a mushroom anchor. However, the anchor could take various forms and configurations. As shown, the anchor comprises an upstanding rod 24 that serves to mount the associated float 22. The illustrated float 22 is an annular inflatable bag structure, comprising an inner annular side wall 28, outer annular side wall 32, top wall 34, and bottom wall 36, formed out of a non-porous fabric that can be collapsed onto rod 24 when the bag structure is depressurized; the water pressure at the sea bottom is sufficient to achieve the desired bag collapse action. In FIG. 1, the collapsed condition of the bag structure is shown by dashed lines 22A.

Float 22, can have varying dimensions, depending on the required lifting force. In atypicai situation, the float could be an annular cylindrical bag structure having an axial length of about twenty (20) inches, and a major diameter of about eighteen (18) inches. Such a bag structure, when inflated, would produce a buoyant lifting force of about one hundred seventy (170) pounds.

The bag structure (float) 22 is retained on rod 24 of the anchor 16 by upper and lower disks, 37 and 38 suitably secured to rod 24. The flexible air conduit 23 is preferably connected to the bag structure 22 by a nonstressed conduit section below clamp 25, whereby the bag structure can be collapsed without stressing the conduit.

The upper end of conduit 23 carries an air valve 40 that is adapted to be connected to an air pressure source, not shown, whereby pressurized air can be directed downwardly through conduit 23 into the float structure 22 for inflation purposes. Valve 40 can be a conventional check valve construction that is commonly used on tires for inflation purposes.

When manual pressure is applied to the valve element stem 41 of the valve 40, the valve is opened to vent air out of the float 22 through conduit 23 and the valve to the atmosphere. This action causes the float 22 to deflate under the pressure of the surrounding water.

Various air pressure-generating devices can be used to supply pressurized air to valve 40. For example, the air pressure source can be a conventional air compressor, a pressurized air cannister, or a manual air pump. An air compressor is the preferred air source.

When the anchor is in its normal operating position on the sea floor, the float 22 will be in a deflated condition; the float will not interfere with the anchoring function that keeps the surface vessel (buoy 12) in a fixed location. In order to raise the float to the water surface, valve 40 is connected to a pressurized air source, whereupon float 22 is inflated to produce a buoyant lifting force on the attached anchor.

In preferred practice of the invention, the float 22 is of sufficient volumetric capacity that the buoyant lift force of the float is sufficient to lift the anchor 16 to the water surface. In some cases, the anchor will be lifted to water surface 14 before float 22 is fully inflated. When the anchor is at the water surface the float-inflation process can be discontinued, since the anchor-lifting function is then attained.

As an optional feature, the line 21 can be equipped with a handle 44. A manual pulling force can be applied to the handle 44 to augment the lifting force of the buoyant float, e.g. to pull the anchor out of an embedded position in a muddy or sandy sea bottom.

The anchor 16 may be lowered to the sea floor 18 by venting air through valve 40, i.e. by depressing the valve stem 41. If desired, a separate air vent valve can be provided at, or near, the upper end of conduit 23, to enable the air venting operation to be more easily accomplished.

Figure 2:
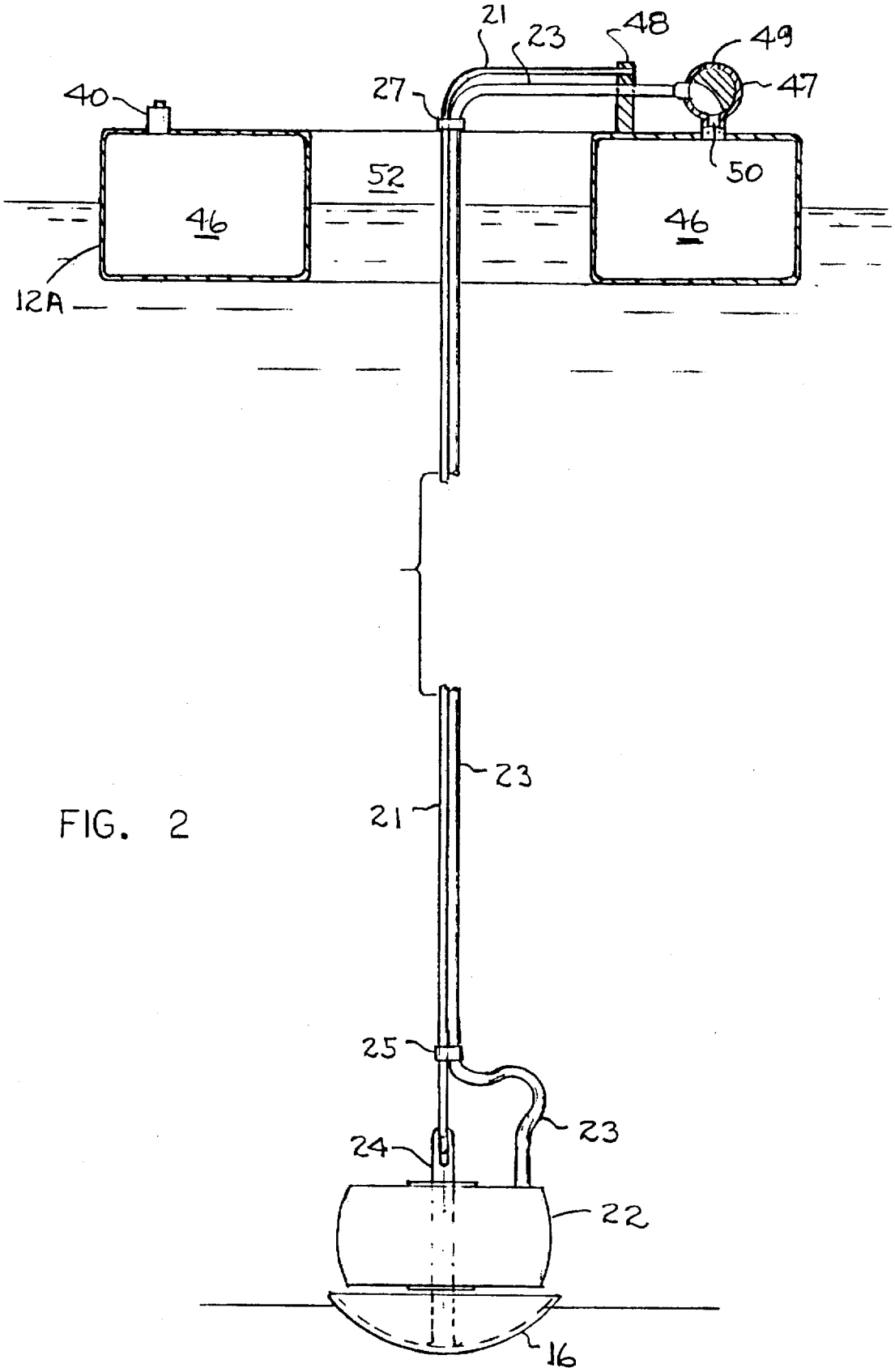
FIG. 2, is an elevational view taken in the same direction as FIG. 1, but showing a second arrangement embodying the invention.

FIG. 2, is an elevational view taken in the same direction as FIG. 1, but showing a second arrangement embodying the invention.

The invention can take various other forms and configurations. FIG. 2 shows one alternative construction that can be used. In this case, the surface vessel is an annular mooring buoy 12A that is sealed to form a pressurizable air chamber 46. The chamber may be air-filled to a specified pressure by connecting an air compressor (not shown) to a conventional tire valve 40 located on the upper wall of the buoy 12A.

Chamber 46 can serve as a pressurized air source for supplying pressurized air to the air conduit 23. Buoy 12A will be sized so that, when chamber 46 is pressurized, it can serve as an air source for several successive anchor-lifting operations. Periodically, chamber 46 can be repressurized so that the chamber is in a readiness state when needed for anchor-lift purposes.

The upper ends of line 21 and conduit 23 are attached to a fixed anchorage 48 on buoy 12A. Conduit 23 continues rightwardly to connect with a three-way valve 47 suitably mounted on buoy 12A. The valve has a vent port 49 and a connection port 50 to the air chamber 46. In the illustrated position of the valve, pressurized air can flow from chamber 46 into conduit 23 so as to inflate the float 22. When the valve element is rotated, a quarter turn clockwise, conduit 23 is connected to vent port 49, so as to deflate the float 23.

The central space 52 circumscribed by buoy 12A can have a larger diameter than anchor 16, so that when the anchor is lifted to the water surface, it can occupy the central space 52 for easy inspection of the anchor and associated connections.

The invention is shown in association with a boat mooring buoy. However, as earlier explained, it could be used with other types of surface vessels.

It is also envisioned, that the inflatable float means, may also be attached at other points on the anchor, or have other shapes, than those described herein.

The present invention, described above, relates to a buoyant anchorage mechanism. Features of the present invention are recited in the appended claims. The drawings contained herein necessarily depict structural features and embodiments of the buoyant anchorage mechanism, useful in the practice of the present invention.

However, it will be appreciated by those skilled in the arts pertaining thereto, that the present invention can be practiced in various alternate forms and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A raisable-lowerable anchorage mechanism comprising:

an anchor adapted to assume an operating position on the sea bottom or an inactive raised position at the sea surface;

an inflatable-deflatable float means carried by said anchor;

a surface vessel operable to support the anchor in its raised position;

air pressure-generating means on said vessel;

air conduit means connecting said air pressure-generating means to said float means, whereby said float means can be inflated or deflated from the sea surface; and said anchor comprising an elongated rod, and said float means comprising an annular float encircling said rod.

2. The anchorage mechanism, as described in claim 1, and further comprising an upper disk and a lower disk secured to said elongated rod; and said float means comprising an annular bag structure encircling said elongated rod between said upper and lower disks.

3. The anchorage mechanism, as described in claim 2, wherein said annular bag structure is formed out of a non-porous fabric.

4. A raisable-lowerable anchorage mechanism comprising:

an anchor adapted to assume an operating position on the sea bottom or an inactive raised position at the sea surface;

an inflatable-deflatable float means carried by said anchor;

a surface vessel operable to support the anchor in its raised position;

air pressure-generating means on said vessel;

air conduit means connecting said air pressure-generating means to said float means, whereby said float means can be inflated or deflated from the sea surface; and said surface vessel comprising an annular hollow mooring buoy having a central unobstructed space large enough to freely accommodate said anchor, whereby the anchor can be lifted through said central space.

5. The anchorage mechanism, as described in claim 4, wherein said pressure-generating means comprises an air check valve-means (40) connected to said hollow buoy, whereby pressurized air can be moved into said buoy; and said buoy being connected to said air conduit means for supplying pressurized air to said conduit means.

6. The anchorage mechanism, as described in claim 4, wherein said pressure-generating means comprises a check valve means (40) connected to said hollow buoy whereby pressurized air can be flowed into said buoy through said check valve means; and a control valve (47) connecting said buoy to said air conduit means, said control valve being openable to flow compressed air from the hollow buoy through said air conduit means into said float means.

* * * * *